United States Patent [19]

Perkins

[11] 4,413,679

[45] Nov. 8, 1983

[54] WELLBORE CATHODIC PROTECTION

[75] Inventor: Thomas K. Perkins, Dallas, Tex.

[73] Assignee: Atlantic Richfield Company, Los Angeles, Calif.

[21] Appl. No.: 375,842

[22] Filed: May 7, 1982

[51] Int. Cl.[3] ..... E21B 41/02; E21B 36/04

[52] U.S. Cl. ..... 166/248; 166/DIG. 1

[58] Field of Search ..... 166/244 C, DIG. 1, 248, 166/65 R

[56] References Cited

U.S. PATENT DOCUMENTS 3,757,860 9/1973 Pritchett ..... 166/DIG. 1

3,766,980 10/1973 Kern ..... 166/DIG. 1

*Primary Examiner*—Stephen J. Novosad

*Assistant Examiner*—William P. Neuder

*Attorney, Agent, or Firm*—Roderick W. MacDonald

[57] ABSTRACT

A method for the cathodic protection of metal conduit in a wellbore in permafrost wherein a predetermined electric current is impressed between said conduit and an anode, the improvement comprising setting said anode in the permafrost away from the wellbore a distance which is greater than the distance between the bottom of the anode and the bottom of the permafrost, and increasing the voltage sufficiently to match the increased resistivity of the permafrost to thereby maintain the predetermined current between the wellbore and anode.

3 Claims, 2 Drawing Figures

WELLBORE CATHODIC PROTECTION

BACKGROUND OF THE INVENTION

Heretofore, as will be described in greater detail hereinafter, in the cathodic protection of metal conduit in a wellbore, an anode has been set in the earth relatively near to the wellbore and an electrical circuit established between the anode and wellbore, part of which circuit was the earth connection between the anode and the wellbore. The anode was normally set into the earth relatively close to the wellbore.

When a wellbore is drilled in northern climates wherein permafrost (permanently frozen earth) occurs to a finite distance below the earth's surface, a problem arises in cathodic protection because the normal resistivity of permafrost is substantially higher than the normal resistivity of unfrozen earth.

This invention is directed towards a method for cathodic protection of metal conduits in wellbores in permafrost, the substantially higher resistivity of the permafrost notwithstanding.

SUMMARY OF THE INVENTION

In accordance with this invention, there is provided a method for the cathodic protection of metal conduit in a wellbore in permafrost wherein an anode is placed in the earth as before. However, by this invention, the anode is deliberately spaced a substantial distance away from the wellbore, the distance being greater than the distance between the bottom of the anode after it is placed in the permafrost and the bottom of the permafrost itself, so that at least a part of the current flowing in the earth between the anode and wellbore passes downwardly through the permafrost into unfrozen earth lying below the permafrost and from there through the unfrozen earth to the wellbore.

Accordingly, it is an object of this invention to provide a new and improved method for the cathodic protection of metal conduits in wellbores in permafrost.

Other aspects, objects and advantages of this invention will be apparent to those skilled in the art from this disclosure and the appended claims.

DETAILED DESCRIPTION OF THE INVENTION

Figure 1:
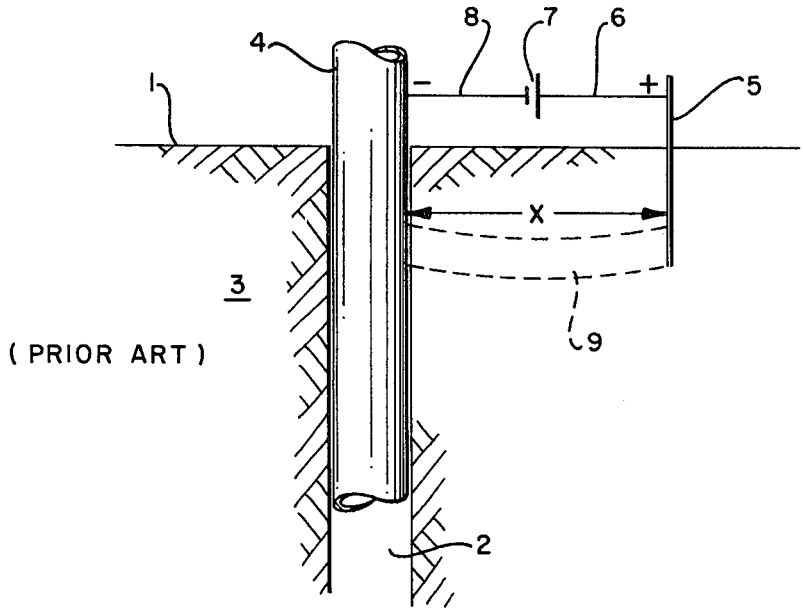
FIG. 1 shows a cross-sectional view of a wellbore and anode in accordance with the prior art.

More specifically, FIG. 1 shows the earth's surface 1 in which wellbore 2 has been drilled. All of the earth 3 surrounding wellbore 2 is unfrozen. A metal conduit such as conventional steel well casing 4 has been set in wellbore 2. The cathodic protection for casing 4 would normally be an electrically conducting metal anode 5 set into the earth a finite distance X from wellbore 2, anode 5 being connected by electrical wire 6 to a source of direct current 7 which in turn is connected by another electrical wire 8 to casing 4. Normally, the connection is negative at the junction of wire 8 and casing 4 and positive at the junction of wire 6 and anode 5. The remainder of the electrical circuit is made up through the earth connection between anode 5 and wellbore 2, casing 5 being in intimate physical contact with the inner wall of wellbore 2. Thus, electrical current flows between anode 5 and casing 4 through the earth as shown by dotted lines 9.

In a conventional application, as represented by FIG. 1, the earth 3 would have a resistivity of about 1000 ohm-centimeters with multiple anodes 5 having a resistance of about ½ ohm. In a conventional application, anode 5 would be placed about 150 feet from wellbore 2, and direct current source 7 would employ about 5 volts so that a 10 amp current is established in the electrical circuit between anode 5 and casing 4.

Figure 2:
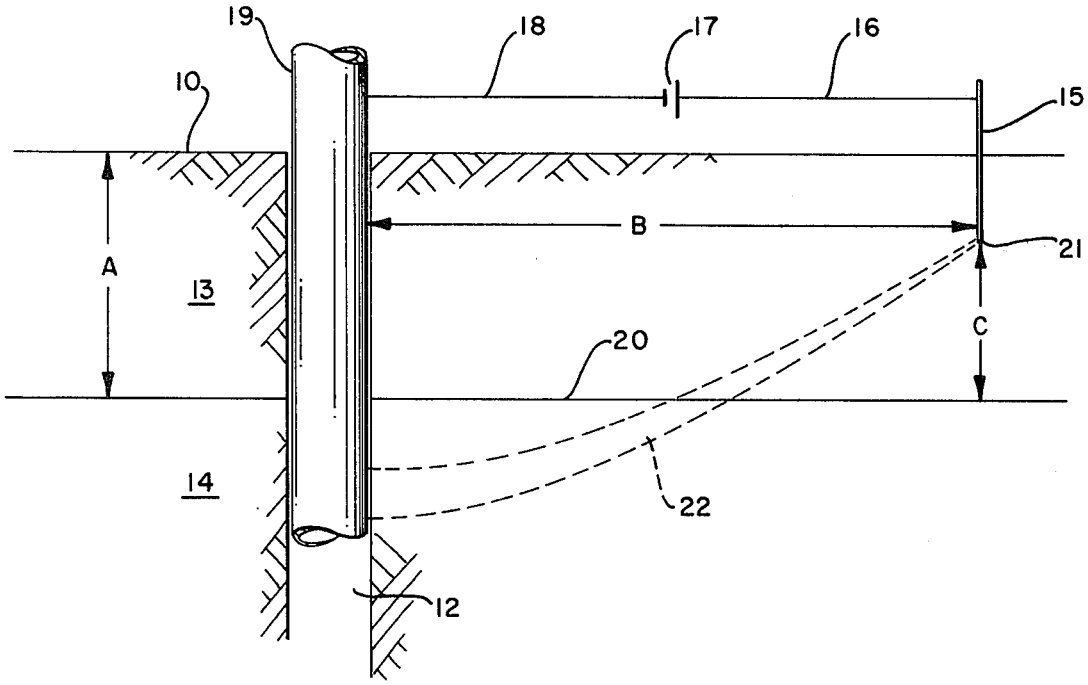
FIG. 2 shows a cross-sectional view of a wellbore and anode in accordance with this invention.

FIG. 2 shows earth's surface 10 with wellbore 12 drilled thereinto. The difference from FIG. 1 is that wellbore 12 is surrounded by permafrost zone 13 that extends a distance A below earth's surface 10, below which permafrost zone 13 lies unfrozen earth 14, so that wellbore 12 pierces first permafrost layer 13 and then unfrozen earth 14. The problem with setting up a cathodic protection system such as that shown in FIG. 1, wherein anode 5 would be placed roughly 150 feet from wellbore 2, is that the resistivity of permafrost 13, instead of being 1000 ohm-centimeters as for unfrozen earth, is instead more likely in the range of 500,000 to 1,000,000 ohm-centimeters. Thus, to maintain a continuous 10 amp current through 100% permafrost requires a much higher voltage.

In accordance with this invention, an anode 15, or multiple anodes, if desired, is placed a finite distance down into permafrost 13, just as in FIG. 1. Anode 15 is connected by electrical wire 16 to direct current source 17 which in turn is connected by electrical wire 18 to metal conduit or casing 19 which extends downwardly into wellbore 12 below bottom 20 of permafrost 13. Casing 19 is also in intimate contact with the inner wall of wellbore 12.

However, the difference between this invention and the prior art is that anode 15 is deliberately placed a distance B away from wellbore 12, distance B being greater than distance C. Distance C is the distance between bottom 21 of anode 15 and bottom 20 of permafrost 13. Thus, if distance C is 2000 feet, then distance B will be greater than 2000 feet, and electrical current 21 will pass downwardly through the permafrost into unfrozen earth 14 and then pass a substantial part of the distance between anode 15 and casing 19 in unfrozen earth 14. This will allow the use of substantially lower voltage than if the current were to pass entirely through permafrost, although some increase in voltage may be necessary in the practice of this invention as well, and will provide for better distribution of current over the entire length of casing 19.

If, as in the standard situation of FIG. 1, an approximately 10 amp net current is desired to be established between the anode and the metal conduit in the wellbore, in the practice of this invention the voltage is normally increased over that usually used for the standard situation. This way, a net current flow between anode 15 and casing 19 of at least about 10 amps is established and maintained.

Distance B will vary widely depending upon the thickness A of permafrost 13, but, as seen from the example above, can be substantial and, in general, should be at least about 1.25 times distance C.

Reasonable variations and modifications are possible within the scope of this disclosure without departing from the spirit and scope of this invention.

I claim:

1. In a method for the cathodic protection of metal conduit in a wellbore, said wellbore being in part in permafrost which has an electrical resistance greater than that of unfrozen earth, wherein said cathodic protection involves impressing a predetermined electrical current by way of a variable voltage in the earth between said conduit and an anode, said anode being set into the earth a finite distance which is less than the depth of the permafrost, said anode being spaced away from said wellbore, the improvement comprising placing said anode a distance away from said wellbore which is greater than the distance between the bottom of said anode and the bottom of said permafrost, and increasing the impressed voltage sufficiently to match the increased resistivity of the permafrost to thereby maintain said predetermined current between said wellbore and anode, whereby at least part of said current between said wellbore and anode passes downwardly through said permafrost into unfrozen earth below the permafrost.

2. The method according to claim 1 wherein said anode is placed a distance away from said wellbore which is at least about 1.25 times the distance between the bottom of said anode and the bottom of said permafrost.

3. The method according to claim 1 wherein said voltage is increased to establish and maintain a net current flow between said anode and wellbore of at least about 10 amps.

* * * * *